United States Patent [19]

Karr

[11] 4,271,642

[45] Jun. 9, 1981

[54] TENT WITH INFLATABLE TUBE ERECTOR

[76] Inventor: Dale A. Karr, 3131 Cauby St., #29, San Diego, Calif. 92110

[21] Appl. No.: 76,509

[22] Filed: Sep. 17, 1979

[51] Int. Cl.[3] ..... E04B 1/345

[52] U.S. Cl. ..... 52/2; 135/3 R

[58] Field of Search ..... 52/2; 135/1 R, 3 R

[56] References Cited

U.S. PATENT DOCUMENTS

| | | | |
|---|---|---|---|
| 1,827,486 | 10/1931 | Poulsen | 52/2 |
| 3,058,127 | 10/1962 | Hassold | 52/2 X |
| 3,338,001 | 8/1967 | Fraser | 52/2 |
| 3,534,750 | 10/1970 | Kolozsvary | 135/1 R |
| 3,899,853 | 8/1975 | Wertman | 52/2 |
| 3,970,096 | 7/1976 | Nicolai | 135/14 V |
| 3,999,333 | 12/1976 | Amarantos | 52/2 |
| 4,031,674 | 6/1977 | Rand | 135/1 R X |
| 4,109,424 | 8/1978 | Block | 52/2 |
| 4,197,681 | 4/1980 | Holcombe | 52/2 |

*Primary Examiner*—J. Karl Bell

*Attorney, Agent, or Firm*—Knox & Knox

[57] ABSTRACT

A lightweight tent for backpackers and like uses and characterized by a generally rectangular floor panel and a double layered canopy, the inner membrane of the canopy being breathable and the outer membrane being waterproof, these membranes being connected to opposite sides of the tunnel surrounding three sides of the floor and extended as an arch over the fourth side of the floor. The tunnel houses an inflatable tube which tends to straighten when inflated and this results in both membranes of the canopy being stretched in spaced relation to define an occupancy space having its greatest height dimension at said arch where a zippered closure flap permits access to the occupancy space.

3 Claims, 6 Drawing Figures

TENT WITH INFLATABLE TUBE ERECTOR

BACKGROUND OF THE INVENTION

The tent art is very old and extensive but the technology relating to erection and support of tents by aerodynamic means is not so extensive. Obviously the selection of rigid poles and the like may lessen the bulk and weight of tent equipment and this becomes extremely important when the tent is to be carried, as in backpacking. The prior art includes means for inflation of tents as in U.S. Pat. No. 4,031,674 which discloses a tent having a single membranous layer defining an occupancy space which must be pressurized by an electric air pump with the problems of leakage at the seams as well as the weight, bulk and cost of the air pump. U.S. Pat. No. 3,909,922 envisages a three layer tent with the inner chamber functioning first as an air-filled form for the outer chamber which is filled with water to form an ice igloo and secondly as an insulator. There appears to be a need for an extremely lightweight, packable tent wherein the erector and support means is made functional without pumps or similar equipment and will not be susceptible to leakage, and which will be economical to manufacture.

SUMMARY OF THE INVENTION

As claimed, the herein disclosed tent is an adequate response to the immediately abovementioned need, being essentially a double layered canopy with the layers, one breathable and the other waterproof, spaced apart by being attached to opposite sides of a tube tunnel on the canopy which is shaped so that the inflation of the tube, by lung pressure, causes the tube to straighten within limits imposed by said tunnel and thus to erect the canopy with an access opening defined by an arched portion of the canopy which is fitted with a zippered closure panel.

DETAILED DESCRIPTION OF A PREFERRED EMBODIMENT

Figure 1:
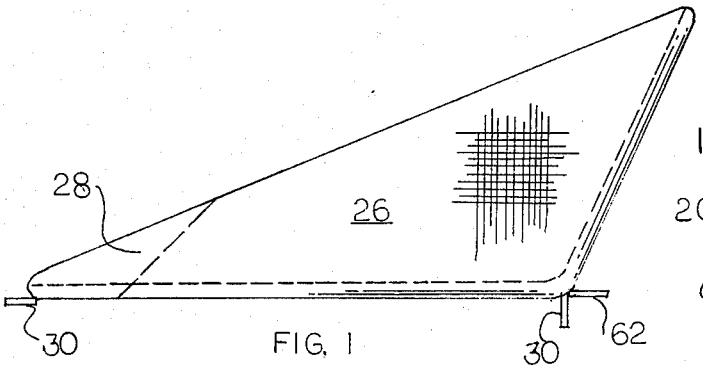
FIG. 1 is a side elevation of the erected tent.

Referring now to the drawing wherein like numerals refer to like or identical parts and portions throughout the views, the disclosed tent includes five principal parts which will be denominated as the canopy 10, the floor panel 12, the tunnel 14 extending marginally of the canopy, the inflatable tube 16, and the closure flap or door 18.

Figure 5:
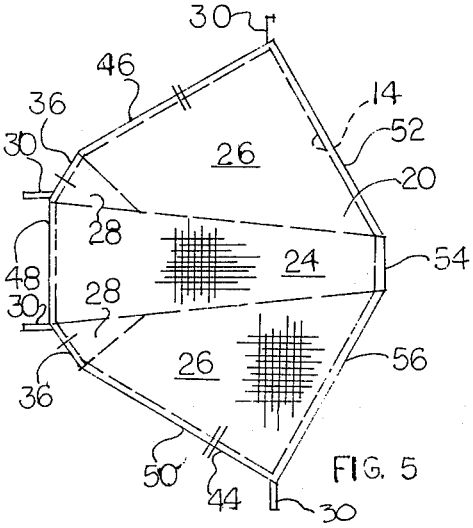
FIG. 5 is a plan view of the canopy as constructed prior to the connection thereof to the floor, this Figure having edges "notches" or indexed to FIG. 6 to show how securement to the floor panel leaves one end of the canopy free to arch upwardly as indicated in FIGS. 1 and 2.

The canopy is dual layered, with an outer membrane 20 and an inner membrane 22 which may be substantially identical except that the outer membrane 20 is of waterproof material and the inner membrane is constructed of breathable material and is slightly smaller to fit inside the outer membrane. Both membranes 20 and 22 have a roof panel as indicated at 24 and opposed generally triangular side wall panels 26—26, the latter being shown constructed with sub-panels 28—28 as shown by the stitching indicated in FIGS. 1, 3 and 5, the FIG. 5 representing the outer membrane 20 of the canopy is expanded and flattened form, that is, not as disposed in the collapsed or erected mode of the tent. Tent stake loops 30, of any suitable form may be attached to the outer membrane as indicated or attached to the floor panel 12 or tunnel 14 if preferred.

Figure 6:
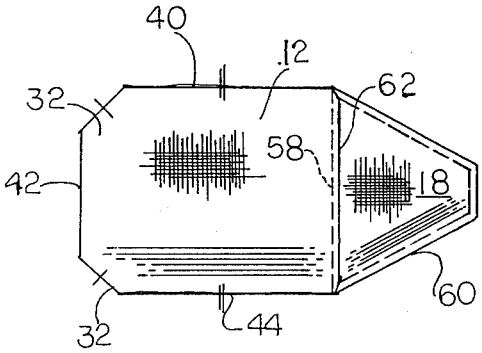
FIG. 6 is a plan view of the floor panel, mud sill and attached door or closure flap prior to the connection thereof to the canopy.

The floor panel 12 is best illustrated in FIG. 6. The generally rectangular form has corner portions cut away as at 32-32 and stitched to tab structure 34 on the tunnel 14 as indicated in FIG. 4, adjacent to the correspondingly dimensioned cutaway corner portions 36—36 of the canopy 10.

Figure 2:
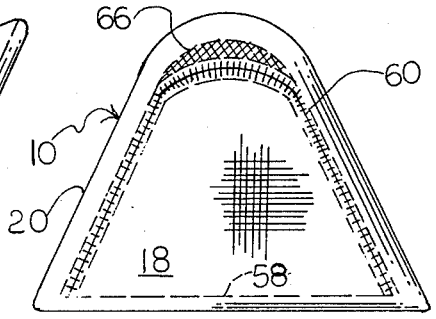
FIG. 2 is an end elevation of the same indicating its zippered closure flap and mosquito net.
Figure 3:
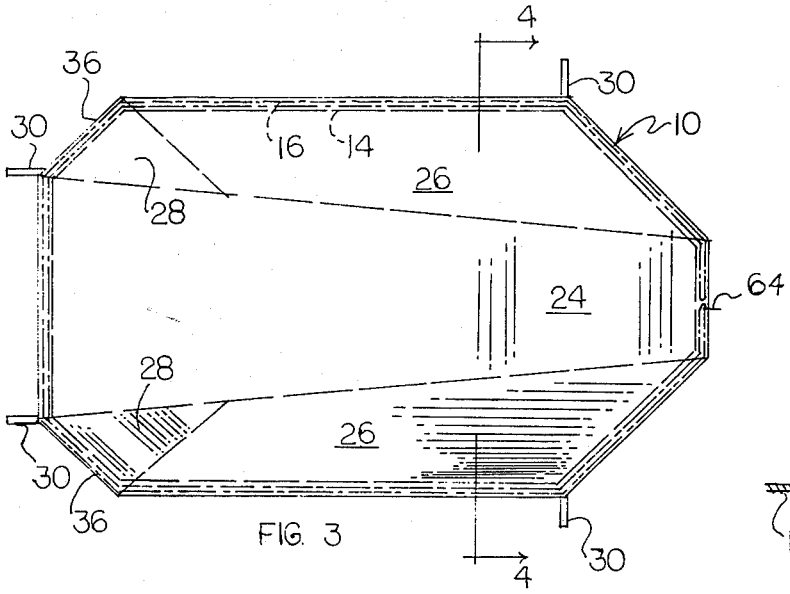
FIG. 3 is a top plan view of the same indicating the tunnel in dash line and the inflatable tube in dot-dash line.
Figure 4:
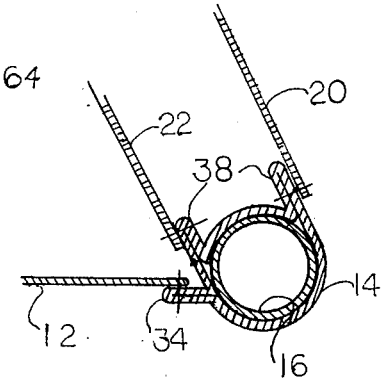
FIG. 4 is an enlarged diagrammatic sketch indicating the relationship, at the line 4—4 in FIG. 3, of the inner and outer membranes of the canopy and the floor with the tube-receiving tunnel, and showing how the membranes are separated.

The tunnel 14 are represented in FIGS. 3 and 4 may be formed separately as by bias stitching of a strip of material into a single elongated tubular form. Further tab structures 38 are provided on the tunnel as indicated in FIG. 4, for connection of the outer and inner membranes 20 and 22 in spaced relation on opposite sides of the tunnel 14. The tunnel 14 is as stated above, secured to the three edges 40–42 and 44 of the floor panel 12, and also to the edges of 46–48 and 50 of both canopy membranes 20 and 22, and to the edges of corner portions 36, it being recalled that the inner membrane 22 is similar and similarly disposed within the outer membrane 20. In this respect it is most important to note that the tunnel 14 also extends along and is attached to the edges 52–54–56 of the canopy and that the inflatable tube 16 extends throughout the tunnel 14 along all the edges of the canopy, that is, along edges 52–54–56 as well. When inflated, the tube 16 within the tunnel 14 has a quite strong tendency to straighten, resulting in the raising of the edges 52, 54 and 56 into the arched position of the canopy at the end thereof remote from the edge 48 as indicated in FIG. 2, and the degree of overhang of the corresponding portions of the roof panel 24 and adjacent end portions of side wall panels 26 is determined by the length of the roof panel 24 and side wall panels 26 which are stretched tight by the force of the inflatable tube 16 as it seeks to straighten. The tube 16 is replaceable. The generally wedge shape of the canopy when the tube 16 is inflated is indicated in FIG. 1 and the tent has an occupancy space of corresponding configuration, with an access opening at the enlarged end which is closed by the door or closure flap 18. This door may be stitched as indicated at 58 to the floor panel 12 and a zipper 60 provides for easy opening and closing. The tube has an air inlet mouthpiece 64. The floor 12 has an extending portion 62 constituting a mud sill, and a mosquito net portion 66 is stitched to and between the zipper 60 and the edge 54 of the roof panel to close a ventilation fenestra at the top of said door.

What I claim as new, and desire to secure by Letters Patent is:

1. A tent, particularly for use by backpackers, comprising:

(a) a canopy of flexible sheet material having a sloping roof panel, opposing generally obtuse angled triangular side wall panels and a generally rectangular floor panel, connected together and capable of defining an occupancy space having a closed apex at one end of said floor panel and an enlarged front opening at the other end of the floor panel, said roof panel extending well beyond said floor panel at said opening as an overhang;

(b) said canopy having a continuous tunnel on three edges only of said floor panel and having an arched segment arching over said front opening; and (c) a flexible inflatable tube within said tunnel and of substantially the same length as said tunnel, said tube having a natural tendency to straighten when inflated within limits imposed by said tunnel, so that said tube when inflated erects said canopy with said roof panel and adjacent portions of said side wall panels extending well beyond said floor panel at said opening as an overhang.

2. A tent according to claim 1, wherein said tunnel has multiple tab structure (34,38) thereon extending radially and longit of the tunnel, and wherein said wall panels each comprise an outer membrane marginally secured to said tab structure on a side of said tunnel remote from said floor panel, and an inner membrane marginally secured to said tab structure on a side of the tunnel close to said floor panel, said membrane being similarly secured to correspondingly opposed sides of said arched segment of the tunnel, whereby said membranes are spaced apart throughout said canopy.

3. A tent according to claim 1 and including a closure panel for said opening marginally secured to said floor panel and releasibly secured marginally to said canopy being smaller in vertical dimension than said opening producing a fenestra between the closure panel and the adjacent portion of the canopy, and a reticulated panel covering said fenestra, said fenestra providing ventilation for the canopy while being protected by said roof panel and adjacent portions of said wall panels extending well beyond said floor panel at said opening as an overhang.

* * * * *